US006067013A

United States Patent [19]

Pejic

[11] Patent Number: 6,067,013

[45] Date of Patent: May 23, 2000

[54] METHOD AND DEVICE FOR INDICATING A REFEREE SIGNAL

[76] Inventor: Nenad Pejic, 10241 Foxwood Dr., North Royalton, Ohio 44133

[21] Appl. No.: 09/132,938

[22] Filed: Aug. 11, 1998

[51] Int. Cl.[7] ..... G08B 1/08; G08B 23/00

[52] U.S. Cl. ..... 340/539; 340/321; 340/323 R; 340/331; 362/800

[58] Field of Search ..... 340/539, 321, 340/323 R, 331, 332; 362/800; 273/459

[56] References Cited

U.S. PATENT DOCUMENTS

| | | | |
|---|---|---|---|
| 4,541,013 | 9/1985 | Alpert | 340/323 R |
| 5,081,568 | 1/1992 | Dong et al. | 362/800 |
| 5,557,253 | 9/1996 | Hegemann et al. | 340/321 |
| 5,697,695 | 12/1997 | Lin et al. | 362/800 |
| 5,745,029 | 4/1998 | Garcia | 340/539 |

*Primary Examiner*—Donnie L. Crosland

[57] ABSTRACT

A system and method for indicating a referee signal is provided. The system includes a signaling device and a signal receiving device. The signaling device has a handle portion, a light source in physical communication with the handle portion and for generating visible light, a power source in circuit communication with the light source, a flag portion in physical communication with the handle portion, and a radio-frequency signal source for generating a radio-frequency signal having a pre-determined code. The light generating portion of the signaling device includes, for example, a plurality of light emitting devices. The signal receiving device includes a radio-frequency receiver and an actuator device. Upon proper receipt of the radio-frequency signal, the actuator device is activated to provide an indication thereof.

20 Claims, 4 Drawing Sheets

METHOD AND DEVICE FOR INDICATING A REFEREE SIGNAL

FIELD OF THE INVENTION

The present invention relates generally to methods and devices for assisting a referee in controlling a sporting event and, more particularly, to methods and devices for indicating a referee signal generated by an assistant referee.

BACKGROUND OF THE INVENTION

Most field sports such as, for example, football (i.e., soccer) are played with two teams matched against each other. Each match is controlled by a referee and two assistant referees. The referee has full authority to enforce the laws of the game in connection with the match to which he or she has been appointed. (Federation Internationale de Football Association (hereinafter "FIFA") Laws of the Game, LAW 5 (1997 Ed.)). However, since the referee is an active element of the game—moving and following play while enforcing the laws of the game there are times when the referee is not in a suitable position to see an infringement or to properly decide the outcome of an infringement of the laws. Additionally, the referee may not have enough time to look away from the center of play to determine whether an infringement of any law has occurred off-play. For this reason, two assistant referees are sometimes provided. (FIFA Laws of the Game, LAW 6.)

Generally, the assistant referees observe the game from each sideline of the playing field and, more particularly, by moving up and down the sidelines following the play on the field. Each assistant referee is generally responsible for only one-half of the playing field. The duties of the two assistant referees, which are subject to the decision of the referee, are to indicate: (1) when the whole ball has passed out of the field of play; (2) which side is entitled to a comer kick, goal kick, or throw-in; (3) when a player may be penalized for being in an offside position; (4) when a substitution is requested; and (5) when misconduct or any other incident has occurred out of the view of the referee. (FIFA Laws of the Game, LAW 6). The assistant referees also assist the referee to control the match in accordance with the general laws of the game.

The manner by which assistant referees indicate the above-mentioned circumstances is to signal the referee by raising and displaying a hand-held flag. However, situations can arise when the raising and displaying of the flag is not seen by the referee. For example, distances of 50 meters or more may separate the referee from an assistant referee. Additionally, the location of the assistant referee and the flag may be difficult to discern for a number of reasons such as, for example, games played at dusk or night may offer poor lighting conditions, the varicolored backgrounds generated by spectators, banners, and flags which are often displayed in stadiums may at least partially camouflage the assistant referee and the flag, and the tempo of the game may be such that the referee does not have enough time to look away from the play of the game to the assistant referee to see if a referee signal is being indicated. Therefore, methods and devices which assist the referee to overcome these difficulties are desirable.

SUMMARY OF THE INVENTION

According to one aspect of the present invention, a device for indicating a referee signal is provided. The device include, for example, a handle portion for holding the device, a light source in physical communication with the handle portion and for generating visible light, a power source in circuit communication with the light source, and a flag portion in physical communication with the handle portion. The device further has a radio-frequency signal source for generating a radio-frequency signal having a pre-determined code which is received by a receiver device. Logic circuitry for controlling the light generating portion and the radio-frequency signal source are also provided. The logic circuitry provides for a plurality of operational modes including, for example, the continuous and intermittent generation of light and a radio-frequency signal generation mode. The light is generated by a plurality of light emitting devices which include, for example, red light emitting diodes.

According to a second aspect of the present invention, a method for generating a referee signal is provided. The method includes, for example, the steps of raising a flag indicative a referee signal and generating visible light proximate to the flag. The method further includes the steps of generating a radio-frequency signal having a predetermined code, receiving the radio-frequency signal, and generating an indication of receipt. The generation of the indication of receipt includes, for example, the step of actuating a vibrator device. The step of generating light proximate to the flag, includes, for example, the step of intermittently generating of light and/or the step of continuously generating light.

Therefore, it is an advantage of the present invention to provide a highly visible device for indicating a referee's signal.

It is another advantage of the present invention to provide a device and method which generates visible light and radio-frequency signals which are indicative of a referee's signal.

It is yet another advantage of the present invention to provide a device and method for indicating a referee signal which is simple to learn and to use.

Still further advantages will be more apparent from a consideration of the ensuing detailed description of the preferred and alternative embodiments of the present invention and the drawings.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of this invention.

DETAILED DESCRIPTION OF ILLUSTRATED EMBODIMENT

Figure 1:
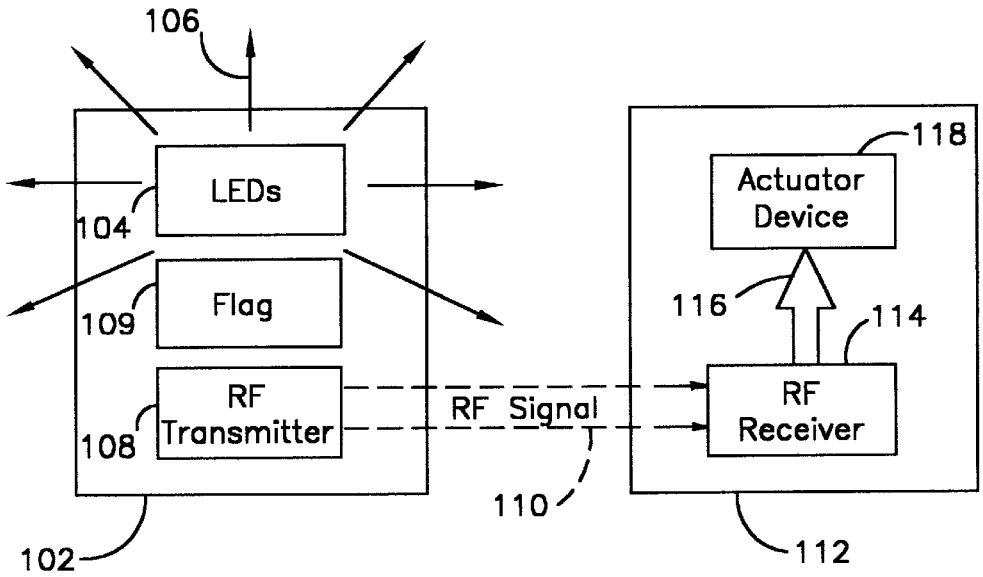
FIG. 1 is a functional block diagram illustrating the system of the present invention.

Referring now to FIG. 1 in particular, a functional block diagram illustrating one embodiment of a system for indicating a referee signal is shown. The system has signaling device 102 for each assistant referee and a signal receiving device 112 for the referee. While only one signaling device 102 is shown, the preferred embodiment includes at least two signaling devices 102—one for each assistant referee.

The signaling device 102 has one or more Light Emitting Devices (hereinafter "LEDs") 104, a flag 109, and a radio-frequency (hereinafter "RF") transmitter 108. Additionally, the signaling device 102 includes logic circuitry (shown in FIG. 4) which will be described in more detail hereinafter. The signal receiving device 112 has a RF receiver 114 and an actuator device 118.

In operation, a referee signal is indicated by displaying the flag 109 and engaging the logic circuitry to selectively activate LEDs 104 to generate light 106 and/or the RF transmitter 108 to generate RF signal 110. The LEDs are preferably high-intensity LEDs such as light emitting diodes or lamps. Once activated, the LEDs may remain on continuously until de-activation by the assistant referee. Additionally, the LEDs may be intermittently turned on and off by the logic circuitry so as to create a flashing or strobe effect. Furthermore, different color LEDs may be provided which further indicate the type of referee signal (e.g., foul, offside, out-of-bounds, etc.) being generated.

If the RF transmitter 108 is active, a RF signal 110 comprising a code is transmitted concurrently with the activation of the LEDs to the RF receiver 114 in the signal receiving device 112. The RF receiver 114 decodes the RF signal 110 and if the transmitted code matches a predetermined code stored in the receiver's memory, the actuator device 118 is activated by actuating signal 116. The RF signal 110 is preferably modulated by any one of a number of modulation techniques including, for example, Frequency Modulation (FM), Amplitude Modulation (AM), or Pulse-Frequency Modulation (PFM). The actuator device 118 is a preferably vibration transducer which, upon actuation, begins to vibrate. Therefore, the vibration of the actuator device 118 signals receipt of the RF signal 110 and indicates that an assistant referee is generating a referee signal.

Figure 2A:
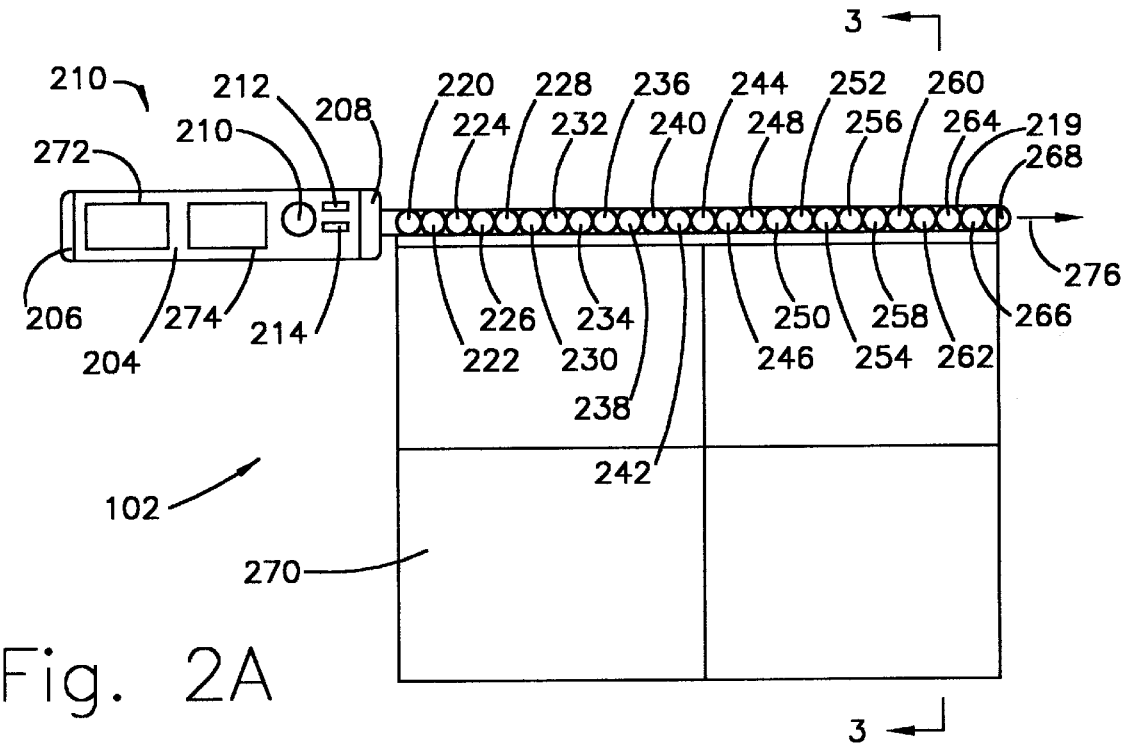
FIG. 2A and 2B are side elevation views of the signaling device of the present invention.
Figure 3:
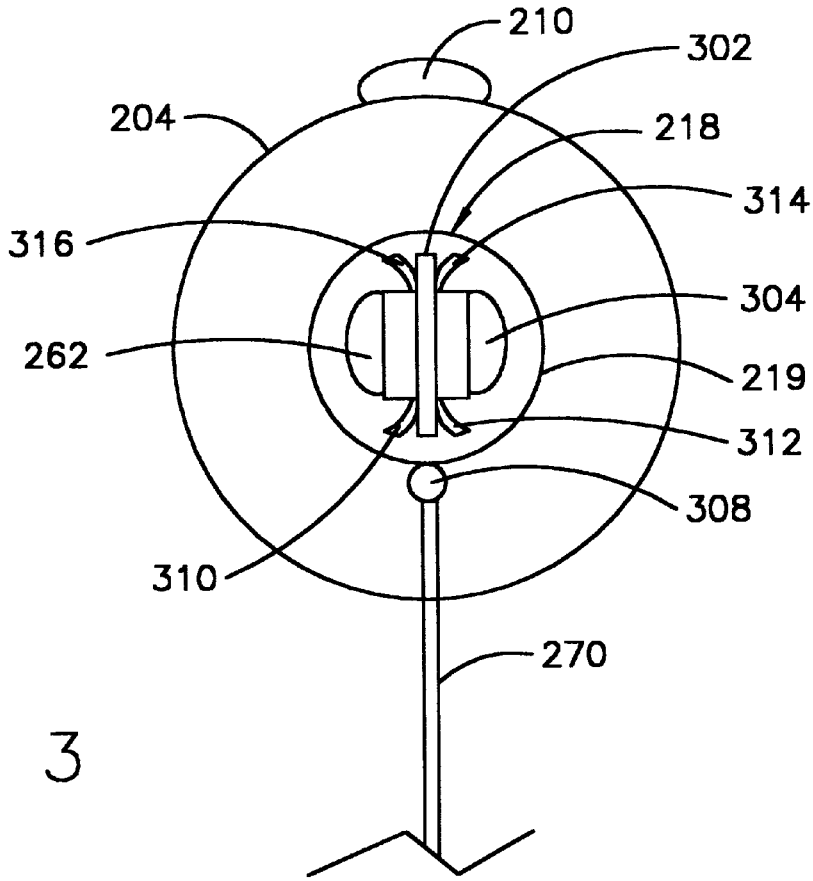
FIG. 3 is sectional view taken along section line 3—3 of FIG. 1.

Referring now to FIGS. 2A and 3, the signaling device 102 of the present invention is shown in greater detail. The signaling device 102 has a handle portion 202, light emitting portion 218 and a flag 270. The handle portion 202 has a housing 204 which includes apertures for switches 210, 212, and 214. Within the housing 204 are contained power sources 272 and 274 and the logic circuitry of the present invention. The power sources 272 and 274 are preferably batteries. The housing 204 further includes an first end cap 206 which is removable and a second end cap 208 which has an aperture for allowing the light generating portion 218 to physically contact the interior of the housing 204. The second end cap 208 may be made of a light transmitting material so as to be able to house additional LEDs to increase the amount of light generated by signaling device 102. The housing 204 is preferably of cylindrical geometry and may include finger depressions or other geometries for functionally stylizing the device such as, for example, a stepped trigger for switch 210.

The light emitting portion 218 preferably includes a cylindrical body 219 having a plurality of LEDs 220–268 disposed therein. The cylindrical body 219 is preferably made from a hard, optically-clear, plastic material. In the alternative, the cylindrical body may be made from a plastic material having the same or similar color as the light generated by the LEDs 220–268. In any event, the color of the plastic material should be such that the intensity of the light emitted from the LEDs should not be substantially diminished. The LEDs 220–268 are preferably of high-intensity and generate light in the red frequency of the visible spectrum. However, LEDs having other color combinations may also be employed.

LED 268 is preferably mounted perpendicular to the general direction of LEDs 220–266. More specifically, LEDs 220–266 are linearly disposed so that they generate light along the length of cylindrical body 219. LED 268 is disposed so that it generates light substantially in the axial direction 276 of the cylindrical body 219. In this manner, LED 268 generates light not only along the axial direction 276, but also along directions which can be as large as 90 degrees from the axial direction 276.

As described above, the light emitting portion 218 may generate light of two or more colors. For example, LEDs 220–242 may generate light of one color such as, for example, yellow, and LEDs 244–268 may generate light of a second color such as, for example, red. Additionally, LEDs 220–268 may be of the type which can provide two distinct colors (ie., yellow and red) based on which electrode of the LEDs is energized. Moreover, LEDs such as LED 268 may be of greater intensity than LEDs 220–266.

Referring now to FIG. 3 in particular, a cross-section taken along section line 3—3 of FIG. 2A is illustrated. The interior of the light emitting portion 218 houses a circuit board 302 upon which LEDs 262 and 304 (and, in FIG. 2, LEDs 220–266) are mounted on opposite sides thereof. Therefore, a second bank of LEDs, as represented by LED 304, which are similar to LEDs 220–266 are also present but oppositely disposed thereof. Other embodiments may include a plurality of banks of LEDs which, for example, are in a spiral configuration along the length of light emitting portion 218, or are in a polygonal cross-section configuration such as, for example, triangular, rectangular, hexagonal, etc. and linearly disposed along the length of light emitting portion 218. The LEDs may also be closely spaced one next to another or more widely spaced therefrom. Additionally, the cross-sectional geometry of light emitting portion 218 may be suitably modified to house such configurations.

The circuit board 302 includes a plurality of traces (not shown) leading from the logic circuitry to the LEDs. Additionally, the interior of light emitting portion 218 may house one or more reflecting surfaces 310–316 for reflecting light generated by the LEDs. The reflecting surfaces 310–316 may be planer or curved. Furthermore, the cylindrical body 219 may have lenses built therein over each LED to further focus or de-focus the light generated from each LED.

Figure 5A:
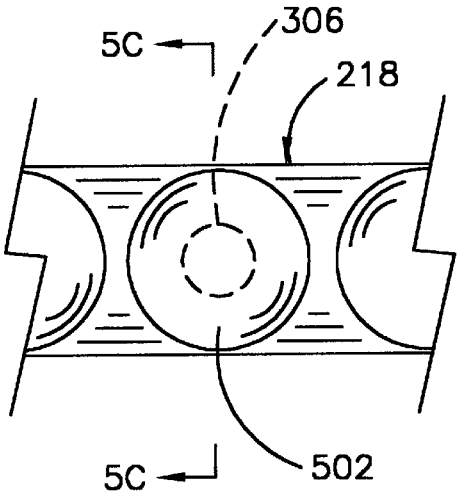
FIGS. 5A and 5C are elevational and sectional views, respectively, of the light generating portion of the present invention with a spherical lens configuration.
Figure 5C:
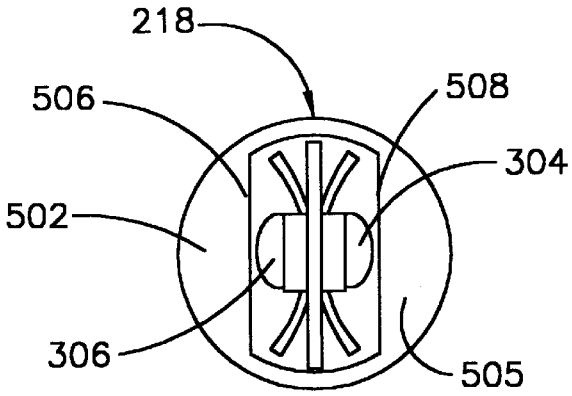

Referring now to FIGS. 5A and 5C, elevational and sectional views, respectively, of the light generating portion 218 of the present invention with a spherical lens configuration is shown. In particular, each LED of light emitting portion 218 such as, for example, LED 306, has a corresponding spherical lens such as, example, lens 502. LED 304 is also shown with its lens 505. The outer surface of lenses 502 and 505 are preferably spherical in nature but may, in the alternative, be elliptical or parabolic (not shown). The inner surfaces 506 and 508 are preferably planar, but may, in the alternative, also be spherical, elliptical, or parabolic (not shown). The LEDs 304 and 306 are preferably placed proximate to the focal point of the lenses 505 and 502, respectively. However, depending on the desired effect (i.e., focusing or de-focusing of the light), the LEDs may be placed in other locations which provide the desired result.

Figure 5B:
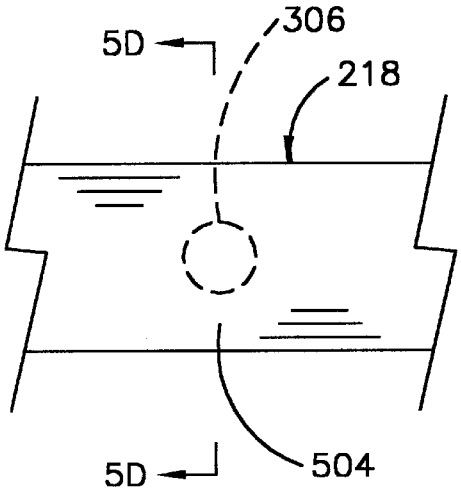
FIGS. 5B and 5D are elevational and sectional view, respectively, of the light generating portion of the present invention with a cylindrical lens configuration.
Figure 5D:
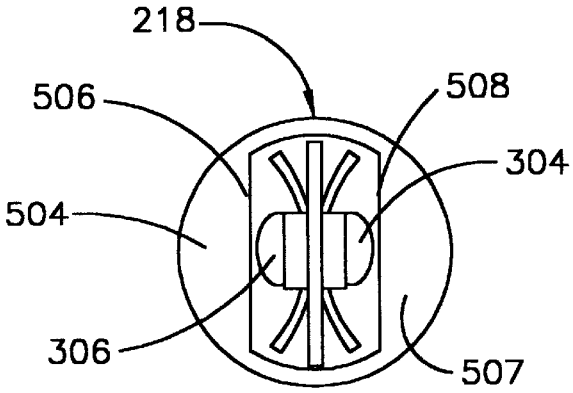

FIGS. 5B and 5D show elevational and sectional views, respectively, of the light generating portion 218 of the present invention with a cylindrical lens configuration. In particular, each LED of light emitting portion 218 is disposed behind a cylindrical lens 504 and 507. The outer surfaces of lenses 504 and 507 are preferably cylindrical in nature with circular cross-sections, but may, in the alternative, have elliptical or parabolic cross-sections (not shown). The inner surfaces are preferably planar, but may, in the alternative, also be elliptical or parabolic in cross-section (not shown).

Other lens configurations are possible such as, for example, segmented lenses which include a plurality of portions wherein each portion includes a spherical and/or cylindrical lens. Additionally, some portions of the plurality may includes windows which simply allow the light exiting light to pass without redirection. Therefore, from the present disclosure, it should be apparent that a number of lens configurations are possible.

Referring to FIG. 2A once again, the flag 270 is preferably mounted on a rod 308. The rod 308 is preferably cylindrical and mounted proximate to the light emitting portion 218. The rod 308 is mounted so that it minimally obstructs the visibility of the light emitting portion 218. In the alternative, the rod 308 may be located within a groove located along the outer surface of the light emitting portion 218 so as to be substantially between reflecting surfaces 310 and 312. In yet another alternative, the flag 270, rod 308, and light emitting portion 218 may be integrated into a non-furling assembly having one or more spindles.

Figure 2B:
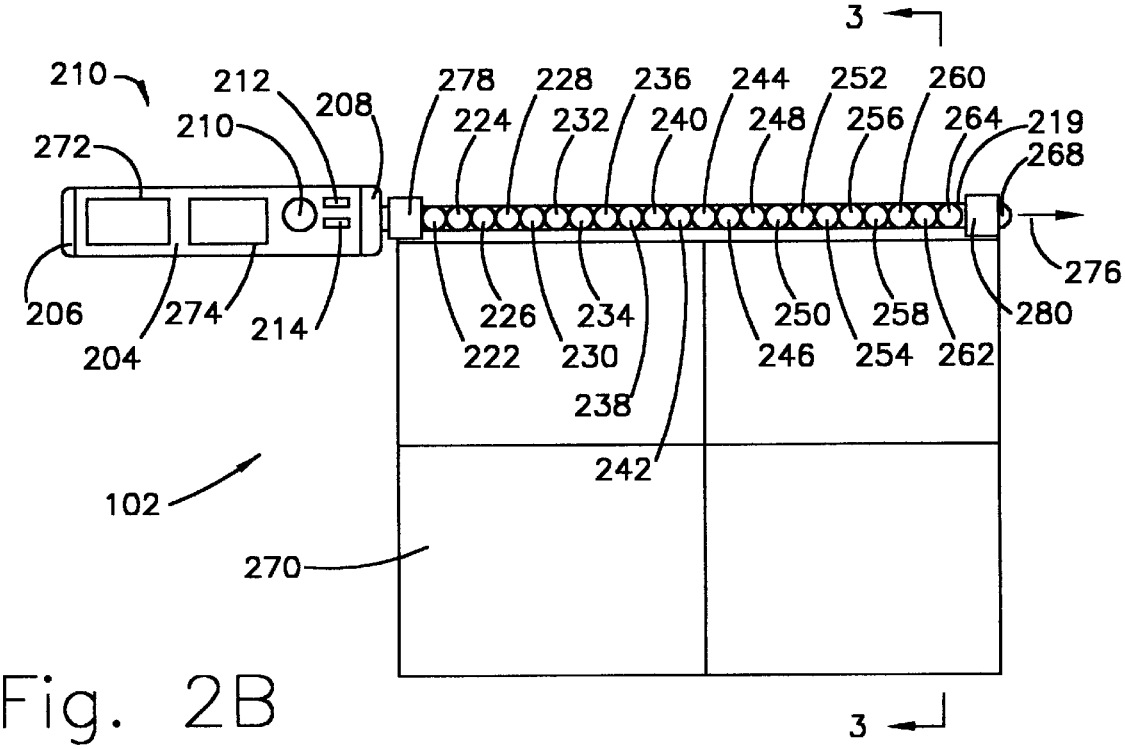

Illustrated in FIG. 2B is the non-furling embodiment of the present invention with spindles 278 and 280. While only two spindles have been illustrated, more than two may be employed such as, for example, an additional spindle at the midpoint of light generating portion 218. Spindle 278 is located near a first distal end of the light generating portion 218 near to the handle portion 202. Spindle 280 is located near a second distal end of light generating portion 218 near to the LED 268. The flag 270 is rigidly affixed to spindles 278 and 280 so as to freely rotated therewith. This connection may be in the form of a plastic rod affixed to spindles 278 and 280 upon which the flag 270 would be attached. Other known means for attaching flags may also be employed. In this manner, the flag 270 will not furl around light generating portion 218 obscuring the light being generated. The spindles 278 and 280 are of light-weight construction and preferably include low-friction plastic bushings with center rods connected to the light generating portion 218. In the alternative, plastic or metal bearing assemblies or any other assembly allowing for low-friction rotational motion may be employed.

Figure 4:
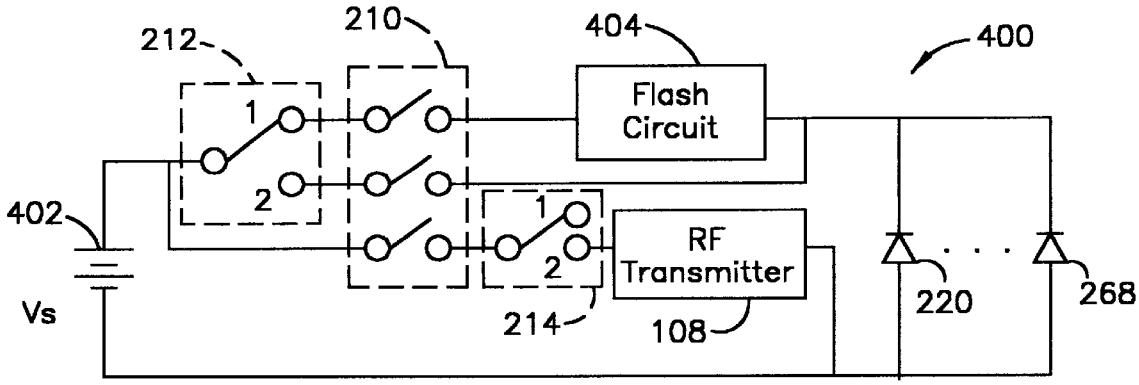
FIG. 4 is a diagram of the logic circuitry of the present invention.

Referring now to FIG. 4, a logic circuit 400 of the present invention is shown. The circuit 400 includes a power source 402, first switch 212, second switch 210, third switch 214, flash circuit 404, RF transmitter 108, and LEDs 220–268. The power source 402 is preferably, as described above, in the form of batteries and a voltage regulation circuit. The voltage regulation circuit maintains a constant voltage output while allowing the input voltage to vary. Voltage regulation circuits are conventional. Switches 212 and 214 are single-pole, double-throw (SPDT switches having switch positions 1 and 2. Switch 210 is a triple-pole, single-throw (TPST) switch.

In operation, switch 212 allows for selection between two light generating modes: a flashing mode and a continuous mode. Accordingly, if the switch 212 is in position 1 and switch 210 is closed, the LEDs 220–268 will generate light in an intermittent manner between an on an off state as defined by the flash circuit 404. The flash circuit 404 is of conventional design. Alternatively, the flash circuit 404 may be incorporated into the LEDs 220–268 themselves. Once again, such LEDs are of conventional design. If the switch 212 is in position 2 and switch 210 is closed, the LEDs 220–268 will generate light in a continuous manner.

Switch 214 selectively switches the RF transmitter 108 between an active and inactive state. Accordingly, if switch 214 is in position 1, the RF transmitter 108 is inactive and closure of switch 210 will only actuate the light generating portion (i.e., LEDs 220–268 with or without flash circuit 404) of the circuit 400. If switch 214 is in position 2, then the RF transmitter 108 is active and closure of switch 210 will actuate both the light generating portion 218 and RF transmitter 108. The RF transmitter 108 is of conventional design and, if active, will upon a momentary closure of switch 210, generate the required RF signal. It should be noted the switching logic, as performed by switches 210, 212, and 214, and the flash circuit 404, can be implemented on a low-cost micro-controller if desired. Also, as describe above, the logic circuitry 400 can be designed to selectively activate only certain LEDs such as, for example, when two or more colored LEDs are employed. In such a case, a circuit having components similarly configured to switch 210, flash circuit 404, and LEDs 220–268, but configured in parallel to these components is provided. In this manner, selective activation of the various LEDs can be achieved depending on which switch 210 is closed. Other combinations of switching logic and LED color configurations are also possible such as, for example, the selective activation of LEDs to form animations, codes, or sequences.

Figure 6:
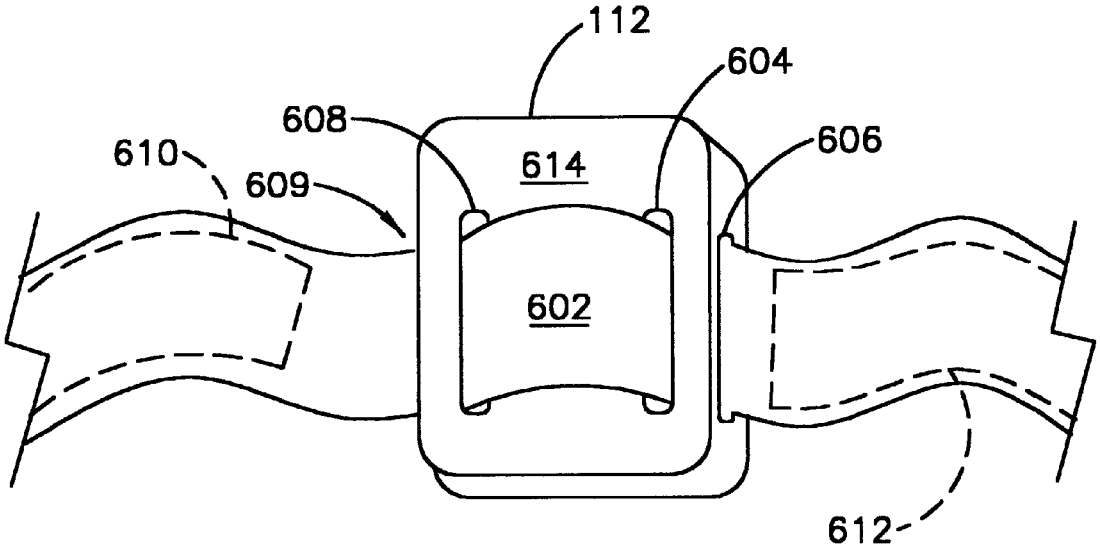
FIG. 6 is a perspective view of the signal receiving device of the present invention.

Illustrated in FIG. 6 is a perspective view of the signal receiving device 112 of the present invention. The signal receiving device includes a plastic housing 614 which includes openings 604, 606, 608, and 609 (not visible). Opening 609 is similar in shape and construction to opening 606. The openings 604–609 are rectangular with rounded ends so as allow fastening belt 602 to pass there through. The fastening belt 602 includes hook and loop-type fastening devices 610 and 612 such as, for example, Velcro® straps, which allow the belt to be fastened closed. So configured, the signal receiving device 112 can be attached to the arm, waist, or other area of a referee so that the vibration of the actuator device 118 (show in FIG. 1) may be felt thereby. In this manner, the referee is free to comfortably located the signal receiving device 112 at a location which does not interfere with his or her required range of physical mobility during a sporting event.

Accordingly, during a sporting event such as, for example, football (i.e., soccer), an assistant referee can indicate a referee signal by raising and displaying the signaling device 102 of the present invention so that the traditional displaying of the flag is enhanced by the generation of visible light and/or a radio frequency signals. The light generation in conjunction with the traditional displaying of the flag improves the visibility of the assistant referee against vari-colored backgrounds generated by spectators, banners, and flags which are often displayed in stadiums and other sporting arenas. Additionally, the present invention greatly improves a referee's ability to see an assistant referee's indication in his or her peripheral vision. This is important because a referee may not have time to directly look at the assistant referee during certain portions of a sporting event. Therefore, the raising and displaying of the flag by an assistant referee accompanied by the dynamic generation of visible light and/or RF signals provides the referee with a greater ability to control the sporting event than has been previously possible.

It should also be noted that the signaling device 102 of the present invention has utility beyond sports. For example, policemen and road construction crews often employ a flag in waving and directing auto traffic. Therefore, the present invention is applicable to any activity where signaling with a hand-held flag is employed or necessary.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art For example, the light generating portion 218 may include circular or rectangular arrays of LEDs along its longitudinal axis, the number of LEDs may be varied, other logic components such as micro-controllers and Programmable Gate Arrays (i.e., PGAs) may be substituted for the discrete logic, and the flag 270 may be made of at least partially reflective materials so to enhance visibility of the light generation, double or triple rows of LEDs may be used, and LEDs may be mounted on spindles. Therefore, the invention, in its broader aspects, is not limited to the specific details, the representative apparatus, and illustrative examples shown and described Accordingly, departures may be made from such details without departing from the spirit or scope of the applicant's general inventive concept.

I claim:

1. A device for indicating a referee signal comprising:

(a) a handle portion for holding the device;

(b) a first visible signal system comprising a flag portion in physical communication with the handle portion and generating a visible flag signal;

(c) a second visible signal system comprising a light source in physical communication with the handle portion and generating a visible light signal, the second visible signal system increasing the visibility of the first visible signal system; and (d) a power source in circuit communication with the light source.

2. The device of claim 1 further comprising a signal source for generating a radio-frequency signal.

3. The device of claim 1 further comprising a switching device in circuit communication with the power source and the light source and for switching the light source between an on and off state.

4. The device of claim 1 further comprising a flash circuit in circuit communication with the light source for intermittently switching the light source between an on and off state.

5. The device of claim 1 wherein the light source comprises a plurality of light emitting devices and a plurality of lenses.

6. The device of claim 2 wherein the switching device is in circuit communication with the signal source and switches the signal source between an on and off state.

7. The device of claim 1 wherein the visible light comprises red light.

8. A device for indicating a referee signal comprising:

(a) a handle portion for holding the device;

(b) a first visible signal system comprising a flag portion in physical communication with the handle portion and generating a visible flag signal;

(c) a second visible signal system comprising a light source in physical communication with the handle portion and generating a visible light signal, the second visible signal system increasing the visibility of the first visible signal system:

(d) a power source in circuit communication with the light source; and (e) a switching device in circuit communication with the second visible signal system and switching the second visible signal system between an on and off state.

9. The device of claim 8 further comprising a signal source for generating a radio-frequency signal.

10. The device of claim 8 further comprising a flash circuit in circuit communication with the at least one light emitting device and for intermittently switching the at least one light emitting device between an on and off state.

11. The device of claim 8 wherein the light emitting portion further comprises an elongated housing having an interior space and wherein the interior space comprises the at least one light emitting device.

12. The device of claim 11 wherein the elongated housing further comprises a partially curved exterior surface.

13. The device of claim 11 wherein the elongated housing further comprises first and second distal ends and wherein the first distal end is in physical communication with the handle and wherein the second distal end comprises a portion having the at least one light emitting device.

14. The device of claim 11 wherein the interior space further comprises a plurality of light emitting devices and a plurality of lenses.

15. A method for generating a referee signal, the method comprising the steps of:

(a) generating a first visible signal by displaying a flag signal; and (b) generating a second visible signal increasing the visibility of the first visible signal by generating visible light proximate the flag signal.

16. The method of claim 15 further comprises the step of generating a radio-frequency signal indicative of the referee signal.

17. The method of claim 16 further comprising the steps of receiving the radio-frequency signal and generating an indication of receipt of the radio-frequency signal.

18. The method of claim 17 wherein the step of generating an indication of receipt of the radio-frequency signal comprises the step of activating an actuator device.

19. The method of claim 15 wherein the step of generating visible light comprises the step of intermittently generating visible light.

20. The method of claim 15 wherein the step of generating visible light comprises the step of generating red light.

* * * * *